United States Patent [19]

Chalat

[11] Patent Number: 4,844,279

[45] Date of Patent: Jul. 4, 1989

[54] ORGANIZER CHEST

[76] Inventor: Kazimierz Chalat, 222 36th St., Miami Beach, Fla. 33140

[21] Appl. No.: 217,390

[22] Filed: Jul. 11, 1988

[51] Int. Cl.[4] ..... B65D 43/20

[52] U.S. Cl. ..... 220/22; 220/94 R; 220/345; 206/373

[58] Field of Search ..... 220/22, 345, 94 R; 206/372, 373

[56] References Cited

U.S. PATENT DOCUMENTS

| | | | |
|---|---|---|---|
| D. 170,728 | 10/1953 | Tavolazzi | 206/373 |
| 2,573,431 | 10/1951 | Gibson | 220/22 |
| 3,303,956 | 2/1967 | Curry, Jr. | 220/22 |
| 3,393,794 | 7/1968 | Borin | 220/345 |
| 3,630,344 | 12/1971 | Bergh | 220/345 |
| 4,084,695 | 4/1978 | Halbich | 220/22 |
| 4,518,092 | 8/1985 | Contrearas | 220/22 |

*Primary Examiner*—A. Michael Chambers
*Attorney, Agent, or Firm*—John C. Malloy

[57] ABSTRACT

An organizer chest with a plurality of rows of compartments for convenient use by a workman to hold tools and a wide variety of separate items; the chest is composed of a plurality of externally accessible rows of compartments peripherally arranged about the chest with separate compartment cover panels covering the various rows of compartments and wherein the chest includes guide tracks along the edges of each compartment at the chest surface to accommodate sliding movement of the cover panels to selectively open and close the compartments.

10 Claims, 5 Drawing Sheets

ORGANIZER CHEST

FIELD OF THE INVENTION

This invention relates to a portable organizer chest for use by a workman to hold tools and other items in any of a plurality of separate compartments so that like or related items are not mixed in one large pile or mass.

BACKGROUND OF THE INVENTION

Many times it is required that workmen have a rather wide variety of separate items conveniently available when during their work, for example, when making rounds in a large building for maintenance purposes. This invention is of an organizer chest which can be carried from place to place; and further, at a particular job, it may be utilized for example by a workman on a stepladder. The invention is shown in two embodiments, one a relatively small organizer chest and the other a relatively larger oganizer chest. In the case of the larger embodiment, it includes a drawer of compartments telescoped in a central core in the organizer chest which can be removed if desired.

OBJECTS OF THE INVENTION

It is an object of this invention to provide an improved organizer chest for use by workmen which is portable, adapted for convenient use at a job site, including on a stepladder, and which is well adapted to maintain a wide variety of miscellaneous items in an organized fashion.

In accordance with these and other objects, the instant invention will now be described with reference to the accompanying drawing in which:

DESCRIPTION OF THE PREFERRED EMBODIMENTS

Figure 1:
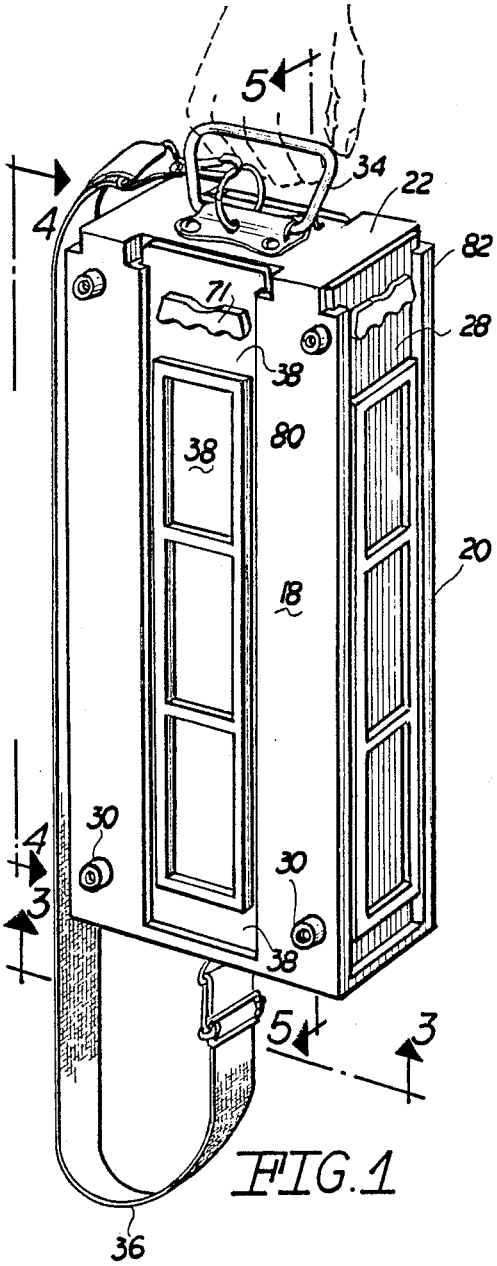
FIG. 1 is a perspective view of one of the embodiments of the organizer chest.

Referring to the drawings, there are two embodiments shown. The first embodiment is shown in FIGS. 1 and 9.

Figure 2:
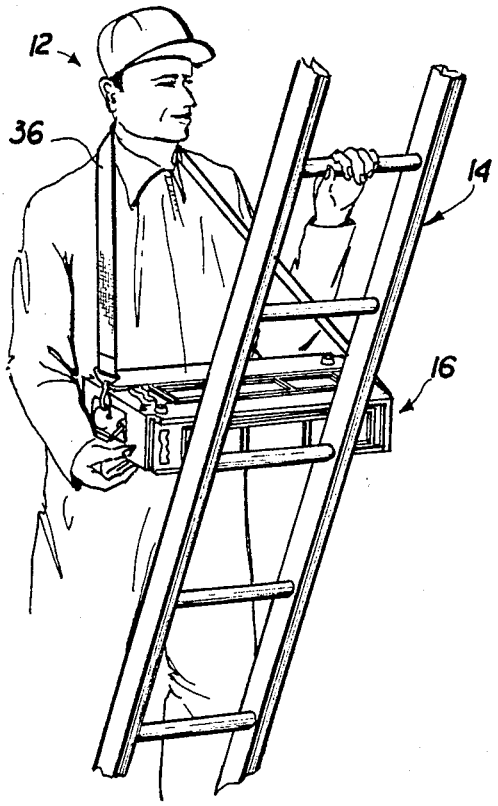
FIG. 2 is a perspective view illustrating the use of the chest.
Figure 3:
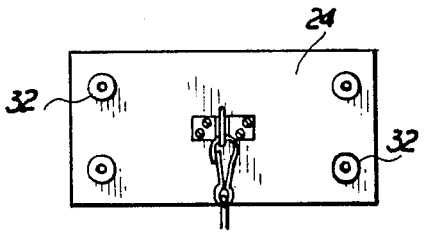
FIG. 3 is a bottom view of FIG. 1.

Referring first to FIG. 2, there is shown a workman 12 on a ladder 14 using the organizer chest 26 of the instant invention. This organizer chest is also seen in FIG. 1 in an upright attitude in which it is easily carried by the handle 34. The chest includes a top wall 18, bottom wall 20, first and second end walls 22 and 24 and sliding side walls one of which is seen at 26 in FIG. 4, and the other of which is seen at 28 in FIG. 1. Preferably, the chest also includes support studs such as 30 on the top and such as at 31 on the bottom walls, 18 and 20 respectively. On the second end wall 24 there are supports 32 which are somewhat longer than those on the top and bottom walls. These supports 32 accommodate clearance for the end of the strap 36 when the chest is positioned in an upright attitude with the second end wall being on a support surface. On the first end wall 22, a handle 34 is provided for use in carrying the chest as indicated in FIG. 1. The strap serves as a sling 36 for use as shown in FIG. 2. Within the chest there are a plurality of separate compartments each for a different item to be used by the workman. The compartments are arranged in rows one beneath the top wall, one beneath he bottom wall and one beneath each of the side walls. In use, the workman is able to rotate the chest about its longitudinal axis to gain access to each of the rows of compartments selecting which row desired.

Figure 5:
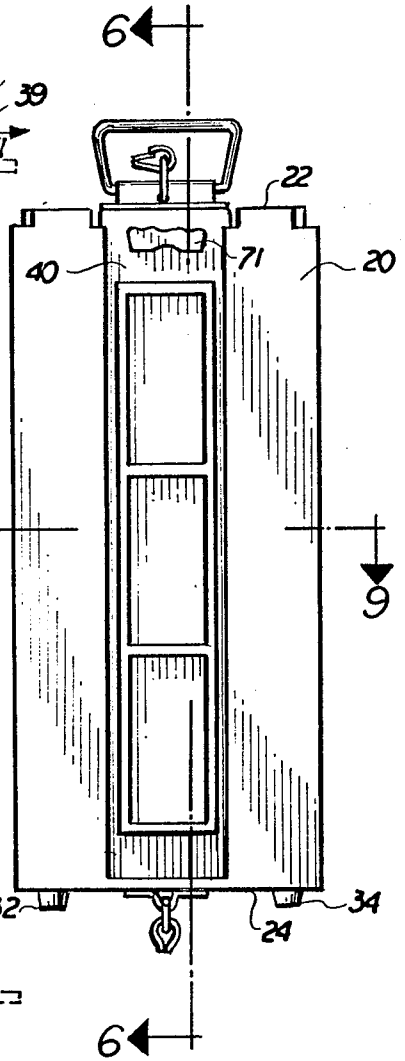
FIG. 5 is a rear elevation view of the chest seen in FIG. 1.
Figure 6:
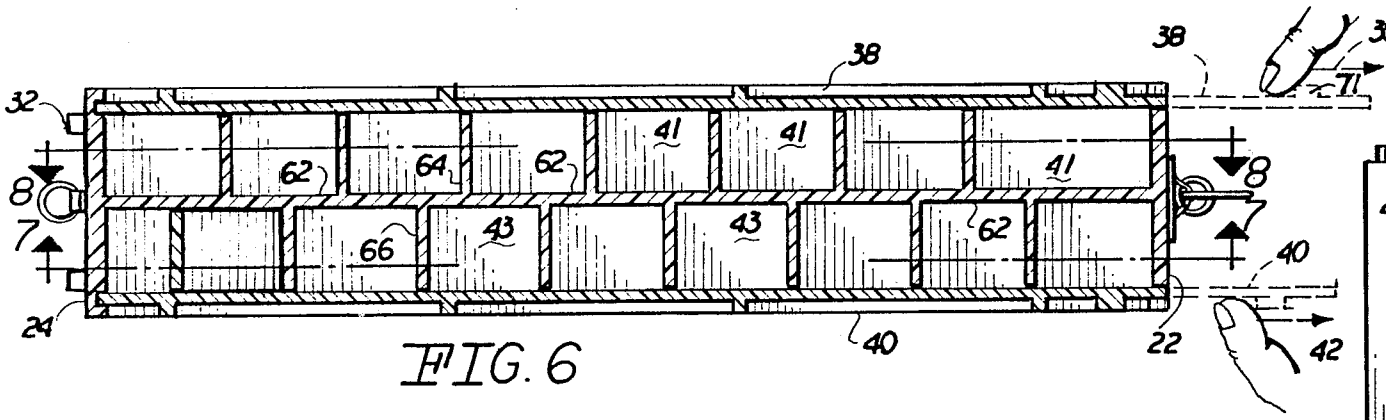
FIG. 6 is a view in cross-section taken on the plane indicated by the line 6—6 of FIG. 5 and looking in the direction of the arrows.

As seen in FIG. 6, a view in cross-section taken through the chest, see FIG. 5, the top wall 18 and the bottom wall 20 each includes a slidable wall panel 38 and 40 respectively. These are each adapted to slide longitudinally and, as shown, and are centrally arranged with respect to the top and bottom walls respectively, that is in the central zone between the slidable side walls 26 and 28. For example, the slidable wall panel 38 in the top wall 18, see FIG. 1, may be slidably moved as indicated in FIG. 6 to gain access to one or the other of the compartments in the rows beneath it. Thus, when slide wall portion 38 is moved in the direction of the arrow 39, see FIG. 6, then the compartments 41 are accessible; and, similarly, when the chest has been rotated through 180° about its longitudinal axis and the slidable wall panel 40 is moved in the direction of the arrow 42, the compartments 43 are accessible.

Figure 4:
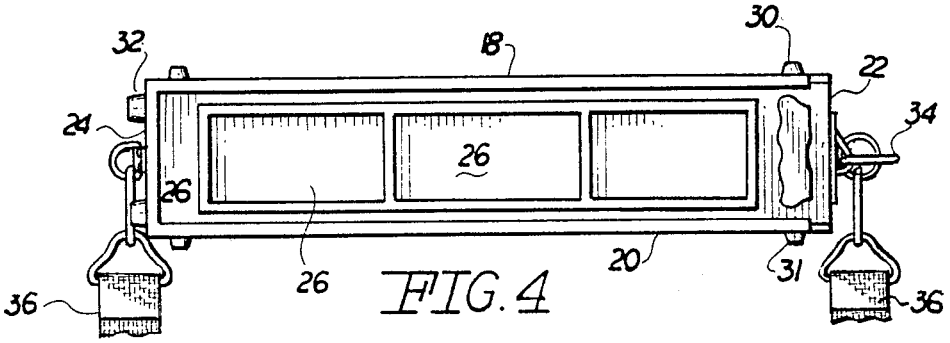
FIG. 4 is a side elevation view of the organizer chest.
Figure 7:
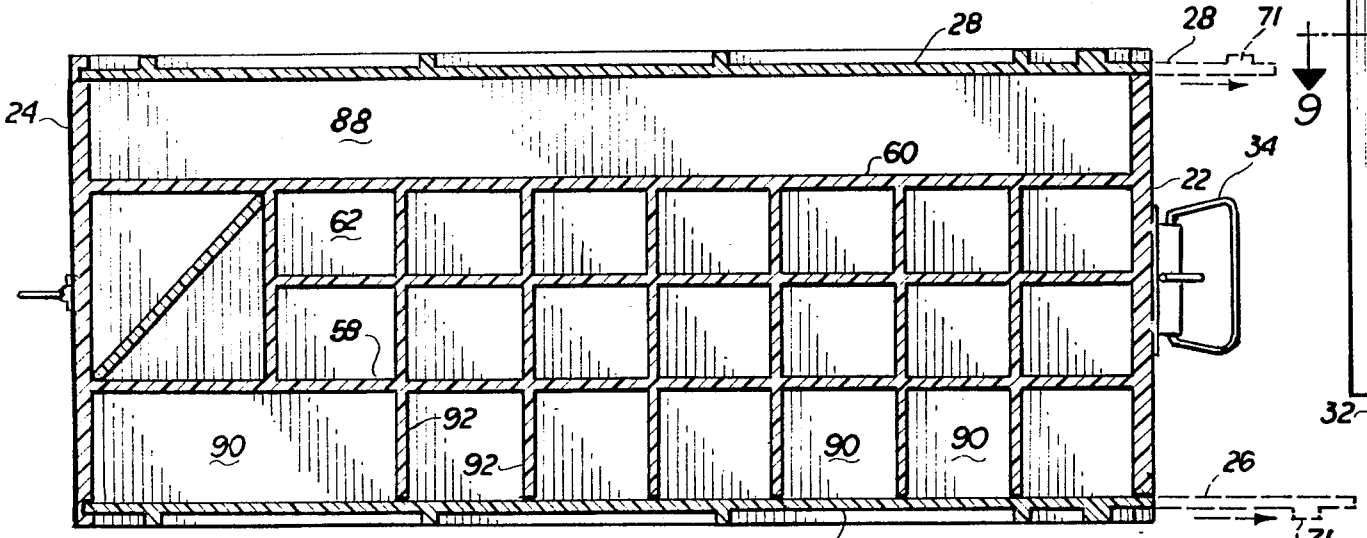
FIG. 7 is a view in cross-section taken on the plane indicated 7—7 of FIG. 6 and looking in the direction of the arrows.
Figure 8:
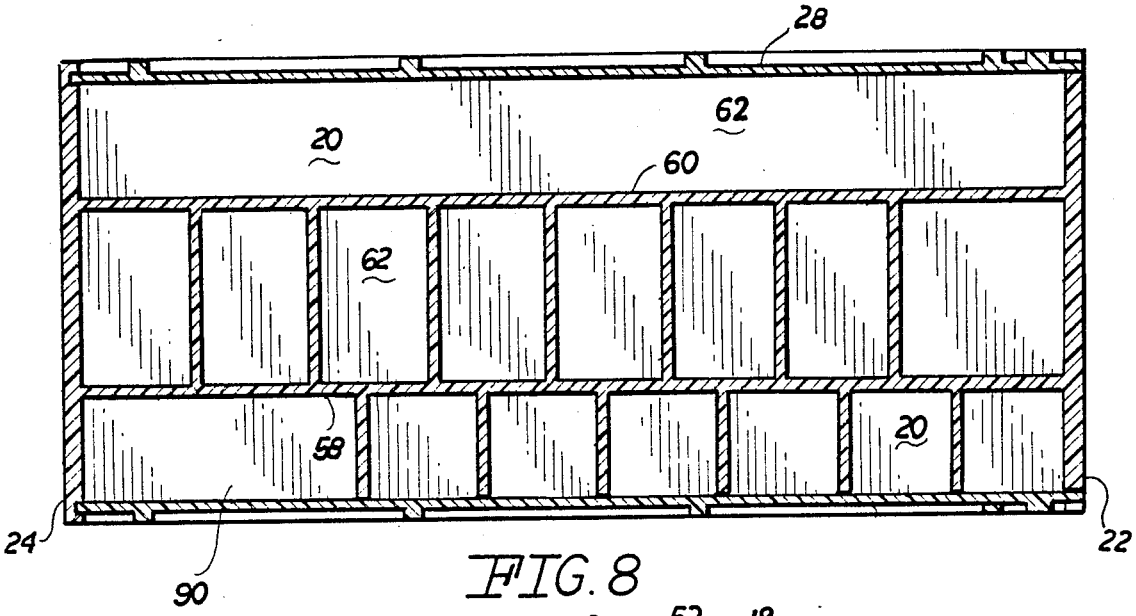
FIG. 8 is a view in cross-section taken on the plane indicated by the line 8—8 of FIG. 6.
Figure 9:
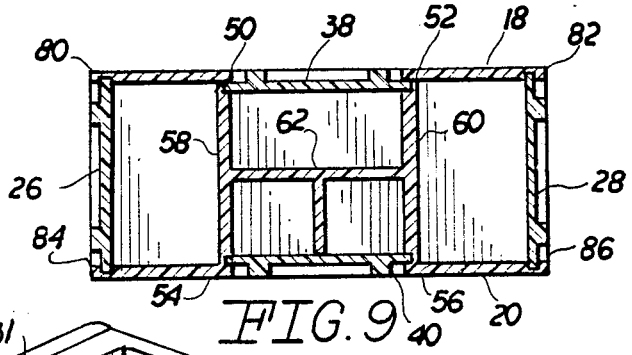
FIG. 9 is a view in cross-section taken on the plane indicated by the line 9—9 of FIG. 5 and looking in the direction of the arrows.

Referring to FIG. 9, it is seen that, to accommodate the sliding action of the wall panels 38 and 40, a pair of confronting slide grooves 50 and 52 and 54 and 56 are provided. These may be in the top and bottom walls or in longitudinally extending septums, 58 and 60. These septums it is seen serve as floors, one for the row of compartments beneath the side wall 26 and one for the row of compartments beneath the slide panel 28. Spanning the septums 58 and 60, there is another septum 62, perpendicular to the parallel septums 58 and 60, which extends between the end walls 22 and 24 and serves as a common floor for the compartment rows 41 and 43, see FIG. 6. From the common floor septum 62 there extend compartment sides, such as 64 and 66, which are each of a common length and separate each of the rows 41 and 43 into the individual compartments shown. In the preferred embodiment, on each of the slidable wall panels there is an operator knob 71 so that it may be used as seen in FIGS. 6 and 7. As indicated in FIG. 1, the side wall 28 as well as the side wall 26, see FIG. 4, are slidable panels. As seen in FIG. 9, slide grooves 80 and 82 and 84 and 86 are provided to accommodate sliding movement of these sliding side walls 26 and 28 and may be composed of longitudinally extending pairs of confronting grooves in the top and bottom walls 18 and 20. It is seen that there is one compartment 88 beneath the slide wall 28 and a plurality of compartments 90 beneath slide wall 26 in this preferred embodiment. The compartments in each row are of a common depth but may be separated by elements, such as 92 spaced at the zone or different distances to define different sized compartments. For example, on reference to FIG. 7, it is seen that tools may be conveniently carried in the elongate compartment 88, while smaller items such as fuses, washers, etc., may be carried in the compartments such as 90 as well as in the row of compartments 41 and 43. It is seen that the second end wall 24 serves as a stop means to constrain movement of the slide panels to movement away from and toward it.

Figure 10:
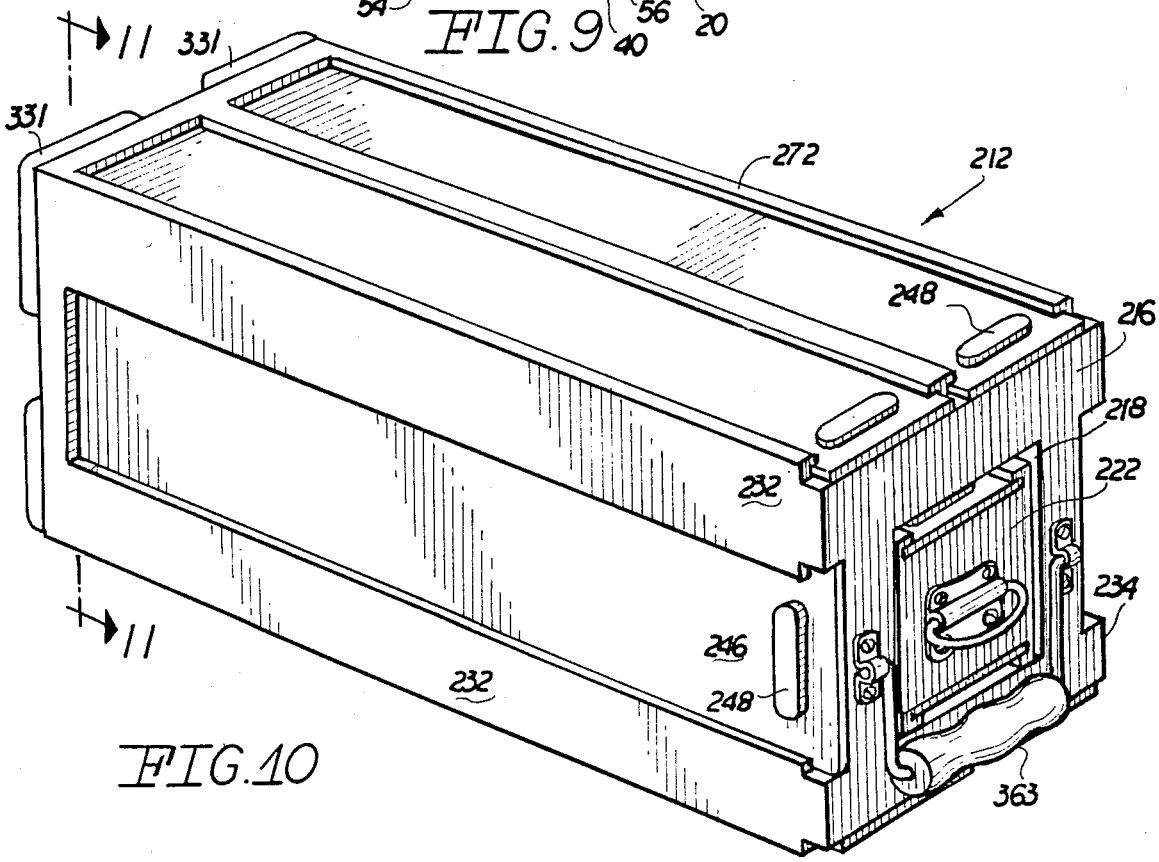
FIG. 10 is a perspective view of a second embodiment of the invention.
Figure 11:
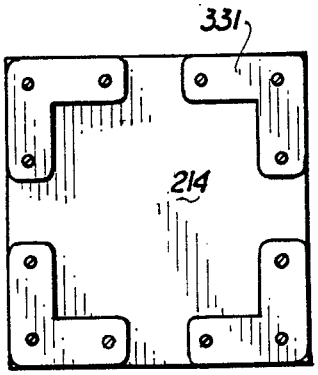
FIG. 11 is an end view as indicated by the line 11—11 in FIG. 10.
Figure 12:
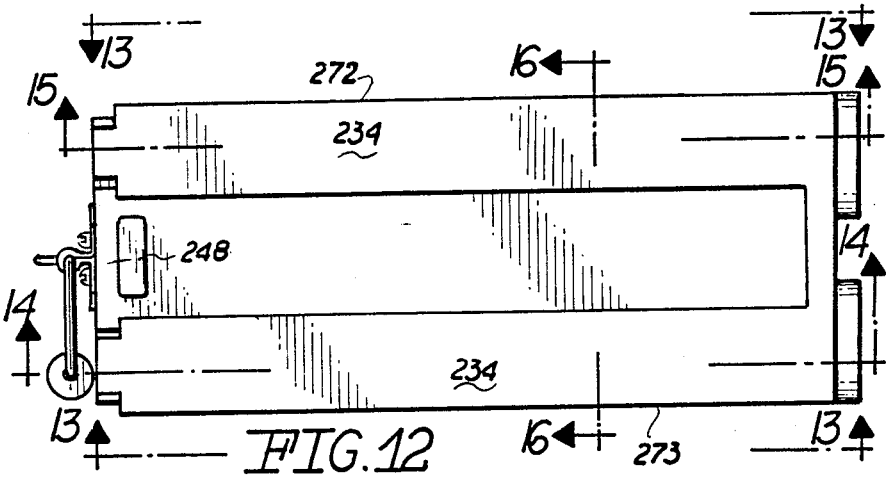
FIG. 12 is a side elevation view of the chest shown in FIG. 10.
Figure 13:
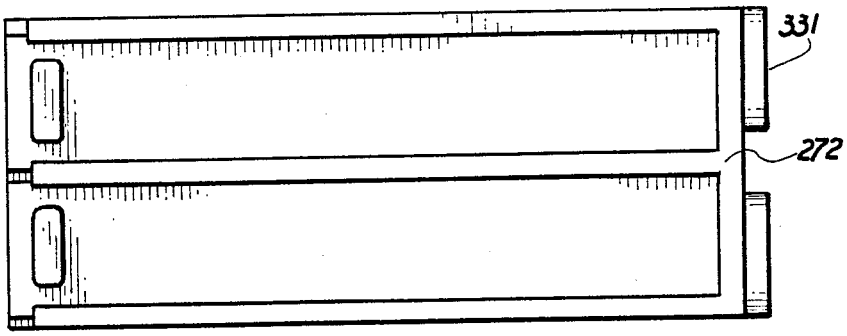
FIG. 13 is a top plan view or a bottom plan view of the chest shown in FIG. 10 as indicated by the lines 13—13 in FIG. 12.
Figure 14:
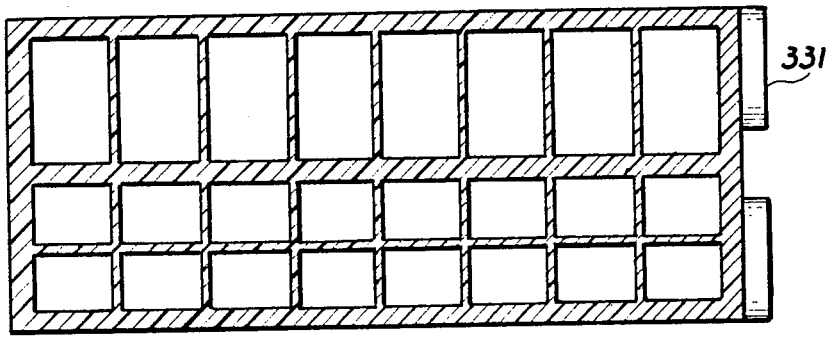
FIG. 14 is a view in cross-section taken on the plane indicated by the line 14—14 of FIG. 12 and looking in the direction of the arrows.
Figure 15:
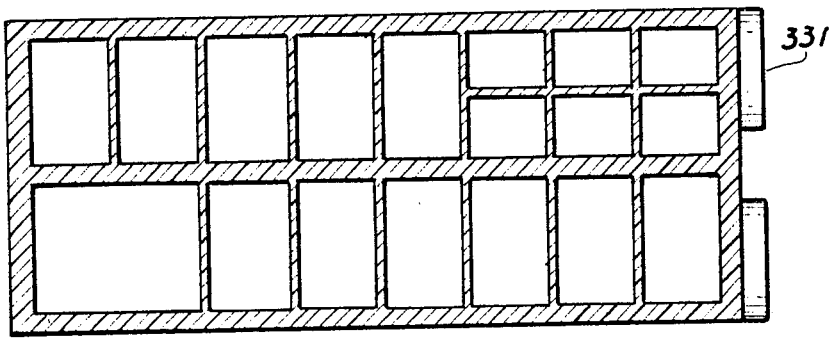
FIG. 15 is a view in cross-section taken on the plane indicated by the line 15—15 of FIG. 12 and looking in the direction of the arrows.
Figure 16:
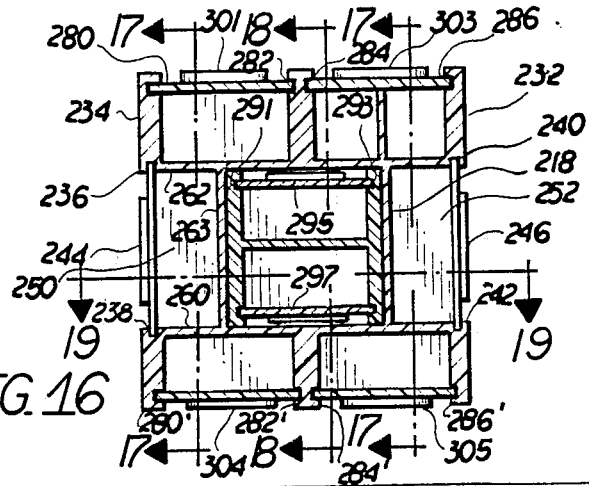
FIG. 16 is a view in cross-section taken on the plane indicated by the line 16—16 of FIG. 12.
Figure 17:
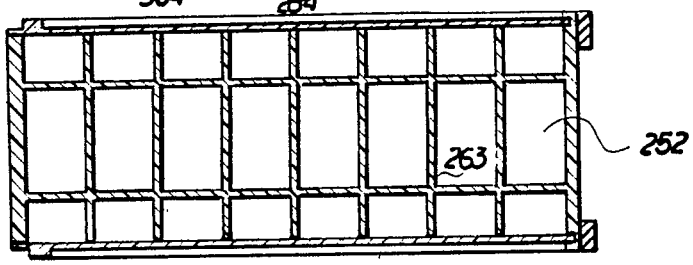
FIG. 17 is a view in cross-section taken on the plane indicated by the lines 17—17 in FIG. 16 and looking in the direction of the arrows.
Figure 18:
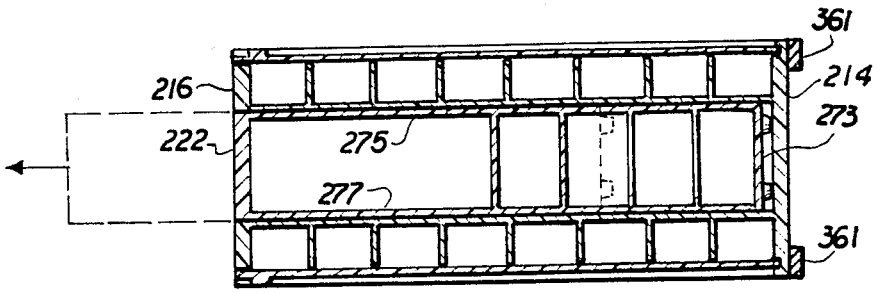
FIG. 18 is a view in cross-section taken on the plane indicated by the line 18—18 in FIG. 16 and looking in the direction of the arrows.
Figure 19:
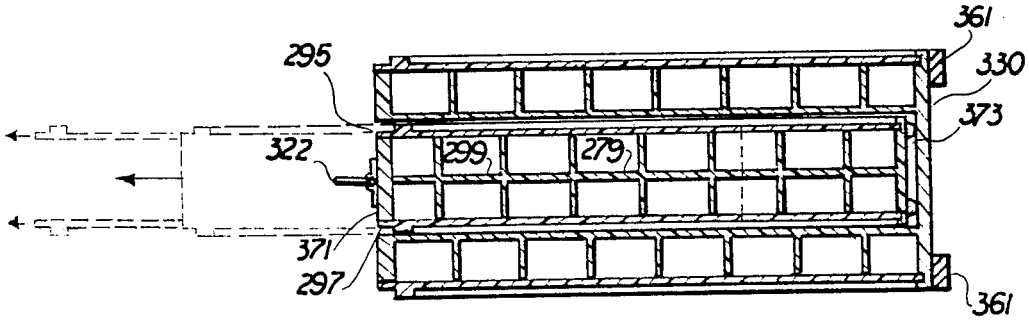
FIG. 19 is a view in cross-section taken on the plane indicated by the line 19—19 in FIG. 16 and looking in the direction of the arrows.

Referring now to FIGS. 10 through 19, a second embodiment of the organizer chest is shown. As seen in FIG. 10, it is generally designated by the numeral 212. It includes opposing end walls, one with an opening 218 centrally arranged in it. This end wall is designated 216 and the other, an opposite end wall, is designated 214, see FIG. 11. The end walls are spanned by side walls to be described more fully hereinafter. Within the organizer chest there is a longitudinally extending centrally located core bounded by a cylindrical septum 218, see FIG. 16. This core is sized to receive a slide drawer 222 telescopically, the same being sized for smooth passage in and out of the core. Referring more particularly to the outer walls of the organizer chest, it is seen that the end walls 214 and 216 are spanned by opposing side walls 232 and 234, see Figures 10 and 12, which are generally U-shaped or composed of elements forming the U-shaped side walls shown. These side walls, 232 and 234, each have a central longitudinally extending opening, each opening being bounded by a pair of slide tracks 236 and 238 and 240 and 242. Slidably received in each of the pair of slide tracks or grooves there is a slide panel, see 244 and 246. Preferably, each has a knob such as 248 to facilitate sliding movement of it. Beneath the slide panels there is a row of compartments such as that designated by the numerals 250 and 252 in FIG. 16. These rows of compartments each have a side defined by a septum such as 260 and 262 in the case of the row 250 which together with the central septum 218 defines the row. The row in turn is separated into compartments by spacer elements such as 263. It is thus seen that there is a central row of compartments 252, seen in FIG. 17, which is accessible when the slide panel 246 is slidably moved to expose them. Similarly, when the slide panel 244 is moved, the row of compartments beneath it is exposed. In the preferred embodiment, the top wall 272, see FIG. 13, is composed of elements forming what may generally be described as a W-shaped member. This is also true of the bottom. As seen in FIG. 16, two pairs of slide tracks 280, 282, and 284 and 286 are provided in the top wall 272 as well as in the bottom wall, see 280', 282', 284' and 286'. A pair of slide panels is received in each of the four pairs of slide tracks, two in the top wall and two in the bottom wall as designated by the numerals 301, 303, 304 and 305. When any one of these side panels are slidably moved, a row of compartments is exposed beneath it, see FIG. 14. In use, it is seen that by slidably moving any of the slide panels, the row of compartments beneath it is exposed. As shown in FIG. 18, the drawer 222 is adapted to be slidably moved into or out of telescopic positionment within the chest organizer, see FIG. 19. Preferably a handle 322 is provided to pull the drawer from the organizer chest. The drawer includes end walls 371 and 373, side walls 275, 277, a longitudinally extending septum 279, and at the top and bottom edges of the side walls 275 and 277 grooves as at 291 and 293 accommodate slide panels 295 and 297 which may be slidably moved to expose a row of compartments contained in the slide drawer. The compartments may be of different sizes as determined by spacer elements such as 299. Preferably, the box is provided with feet 361 so that it may be stored in an upright position if desired. Preferably, it also includes a handle 363 for carrying the box with the slide drawer in it.

In use at a work site if desired, the drawer may be removed and utilized to do the required work. On the other hand, the organizer chest may be used separately for a similar purpose.

The two embodiments provide a highly useful organizer chest for use by a workman at job sites as is apparent from the foregoing description.

In the first preferred embodiment the chest is about 18" in length and about 4" thick and 8" across while in the second preferred embodiment the chest is about 18" to 20" in length and about 8" to 10" thick and across.

While the instant invention has been shown and described in what is considered to be practical and preferred embodiments, it is recognized that departures may be made thereform within the spirit and scope of this invention which is, therefore, not to be limited except as set forth in the claims hereinafter and in accordance with he doctrine of equivalents.

What is claimed is:

1. A portable organizer chest for storage of a variety of items comprising, a first rectangular end wall and a second rectangular end wall, said end walls being in spaced confronting relation, each of said end walls having a first and second pair of parallel edges and the edges of said second pair being perpendicular to the edges of the first pair, first and second septum means extending in parallel spaced relation with respect to one another between and in perpendicular relation to the first and second end walls, said first septum means being adjacent and parallel to one of said first pair of edges and spaced inwardly therefrom and said second septum means being adjacent and parallel to the other of said first pair of edges and spaced inwardly therefrom and said first and second septum means defining a space between said first and second septum means, third septum means extending between and in perpendicular relation to the first and second end walls and in particular relation to and spanning said first and second septum means, a first, second, third and fourth wall means, each extending in perpendicular relation to one of the edges of said end walls in close adjacent relation thereto, said wall means each including spaced track means extending between the end walls in perpendicular relation thereto, each of said wall means including a slide panel slidably captivated between the track means of each of said wall means and in spaced relation of said septum means, said wall means and septum means defining rows between the walls means and the septum means extending between the end walls, and one of said slide panels being in covering relation of each of said rows, stop means on said first end wall to constrain sliding movement of said slide panels to a common direction of sliding movement toward said first end wall, and spacer element means spanning said septum means and wall means to define compartments between the spacer element means, septum means, slide panels and wall means for containing and captivating items when the slide panels are all in covering relation of said rows for selective movement of a slide panel to open one of said rows.

2. The device as set forth in claim 1 wherein the first and second wall means span the third and fourth wall means and said first and second wall means each include a centrally arranged spaced track means and said slide panel extends substantially between the third and fourth wall means.

3. The device as set forth in claim 2 wherein the third and fourth wall means each include a centrally arranged track means defining guide tracks spaced from one another and including said first and second wall means.

4. The device as set forth in claim 1 wherein handle means are provided on said second end wall.

5. The device as set forth in claim 1 wherein support feet are arranged on the exterior of said organizer and on said first end wall.

6. The device as set forth in claim 1 wherein each of said slide panels includes a knob for use in sliding movement thereof.

7. The device as set forth in claim 1 wherein said track means comprise grooves and each of said panel includes longitudinally extending edges sized for sliding receipt in said grooves.

8. The device as set forth in claim 1 wherein said first and said second wall means include a pair of two parallel track means.

9. The device as set forth in claim 1 wherein said septum means defines a central recess extending from said first end wall to said second end wall and said second end wall is provided with an opening into said recess and said chest includes a drawer means, said drawer means being sized for slidable receipt in said central recess and said drawer means includes structure defining spaced compartments therein.

10. The device as set forth in claim 9 wherein said drawer means includes spaced end panels, septum means extending between the end panels defining a row on opposite sides of said septum means, said drawer means having sides including guide tracks and including slide panels covering each of said rows and slidable in said guide tracks and said drawer means further including spacer means separating the rows into a plurality of separate compartments.

* * * * *